US006264004B1

(12) United States Patent
Miyamoto

(10) Patent No.: US 6,264,004 B1
(45) Date of Patent: Jul. 24, 2001

(54) MAST APPARATUS AND LIFT TRUCK

(75) Inventor: Yasuhiro Miyamoto, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/201,792

(22) Filed: Dec. 1, 1998

(30) Foreign Application Priority Data

Dec. 1, 1997 (JP) ..... 9-330605

(51) Int. Cl.[7] ..... B66F 9/06
(52) U.S. Cl. ..... 187/222; 187/238
(58) Field of Search ..... 187/222, 230, 187/255, 226, 236, 227, 409, 410, 238

(56) References Cited

U.S. PATENT DOCUMENTS 3,061,047 * 10/1962 Gunning ..... 187/230 X
3,360,078 * 12/1967 Hopfeld ..... 187/236 X
3,854,699 * 12/1974 Garnett ..... 187/253 X
3,972,388 * 8/1976 McVeen ..... 187/253 X
5,752,583 5/1998 Schönewald ..... 187/227

FOREIGN PATENT DOCUMENTS 2-86600 * 3/1990 (JP) ..... 187/236
7-157295 * 6/1995 (JP) .
7-187592 * 7/1995 (JP) .

* cited by examiner

*Primary Examiner*—Christopher P. Ellis
*Assistant Examiner*—Thuy V. Tran
(74) *Attorney, Agent, or Firm*—McDermott, Will & Emery

(57) ABSTRACT

A carrier (21) for carrying a load-handling attachment (27) is lifted along a guide mast (1, 11) by a lift drive (19, 29) including a lift chain (19) connected to the carrier (21), and a swing restrictor (31) is provided on the guide mast (1, 11) to restrict a swing motion of the lift chain (19).

20 Claims, 15 Drawing Sheets

MAST APPARATUS AND LIFT TRUCK

BACKGROUND OF THE INVENTION

The present invention relates to a mast apparatus for lift trucks and a lift truck equipped with a mast apparatus. More specifically, the invention relates to a mast apparatus and a lift truck, in which a carrier for carrying a load-handling attachment is lifted and lowered by a lift chain along a guide mast, and the lift chain tends to swing.

FIGS. 1 and 2 show typical states of a conventional mast apparatus in the form of a mast-guided fork lift, with a fork lowered to and slightly lifted from a floor or ground. The mast apparatus has a pair of left and right outer rails 1, in a view along a longitudinal direction of a vehicle body (not shown) of a fork lift truck equipped with the mast apparatus. The left and right outer rails 1 are interconnected for integration by a plurality of beam members extending in a transverse direction of the vehicle body. A lowest beam member 3L has support brackets 5 integrally provided thereto for a pivotal support on a front axle (not shown) as part of a body of the fork lift truck to permit a pivotal motion in the longitudinal direction. An upper beam member 3U is provided with L-shaped brackets 4 at left and right ends thereof, and is integrally connected via the brackets 4 to the left and right outer rails 1. For the outer rails 1 to be longitudinally tilted relative to the vehicle body, left and right tilt cylinders 9 are interposed therebetween. Each tilt cylinder 9 is pivoted at a base end thereof on a part 7 of the vehicle body, and at an end of a piston rod 9P thereof to one of the outer rails 1.

The left and right outer rails 1 have a pair of left and right inner rails 11 provided on transversely inner sides thereof in a vertically movable manner. The left and right inner rails 11 are interconnected for integration by a plurality of beam members extending in the transverse direction. An uppermost beam member 13U projects at left and right ends thereof outside the left and right outer rails 1. The left and right ends of the uppermost beam member 13U each have a chain wheel bracket 15 integrally provided thereto.

A chain wheel 17 is provided on a transversely inner side of the chain wheel bracket 15, and is rotatably supported thereon. A lift chain 19 is applied over the chain wheel 17, and is connected at one end thereof to an anchor bolt 23, which is provided to a lower part of a carriage 21 that is vertically movable along the inner rails 11 that serve as guide masts therefor. The other end of the lift chain 19 is connected to another anchor bolt 25, which is attached near an upper part of outer rail 1 in a vertically shiftable manner. The carriage 21 carries a plurality of forks 27 for handling a load.

The inner rails 11 are actuated to vertically move relative to the outer rails 1, so that the carriage 21 and the forks 27 are lifted and lowered along the inner rails 11. For the actuation, the outer rails 1 are equipped with a pair of left and right lift cylinders 29, which have their vertically movable piston rods 29P connected to the uppermost beam member 13U between the inner rails 11.

As the piston rods 29P of the lift cylinders 29 vertically move, the inner rails 11 vertically move relative to the outer rails 1, causing the carriage 21 and the forks 27 to be lifted and lowered. When the fork lift truck travels, the forks 27 are held in a slightly lifted position as in FIG. 2.

As the fork lift truck travels, a length of the lift chain 19 between the chain wheel 17 and the anchor bolt 23 has a varying tendency to swing in the longitudinal and transverse directions, as in FIG. 2, depending such as on the condition of travel route as well as on a loading condition to the forks 27. The lift chain 19 may have a large swing, directly hitting the outer rail or the like, causing a coat on the chain such as grease to be spattered, producing uncomfortable sounds, and/or interrupting a sight of a lift operator. Frequent direct hits on the outer rail may render a potential chain life shorter.

SUMMARY OF THE INVENTION

The present invention has been achieved with such points in view.

It therefore is an object of the present invention to provide a mast apparatus for lift trucks, in which a lift chain has a reduced tendency to swing, to cope with conventional issues. It also is an object of the present invention to provide a lift truck equipped with a mast apparatus, in which a lift chain has a reduced tendency to swing, to cope with conventional issues.

To achieve the object, an aspect of the invention provides a mast apparatus for lift trucks, comprising a carrier for carrying a load-handling attachment, a lift drive for lifting the carrier, the lift drive including a lift chain connected to the carrier, a guide mast for guiding the carrier along the guide mast, and a swing restrictor provided on the guide mast for restricting a swing motion of the lift chain.

Another aspect of the invention provides a lift truck comprising a vehicle body supported by a plurality of wheels, a carrier for carrying a load-handling attachment, a lift drive for lifting the carrier, the lift drive including a lift chain connected to the carrier, a guide mast supported by the vehicle body for guiding the carrier along the guide mast, and a swing restrictor provided on the guide mast for restricting a swing motion of the lift chain.

According to the aspects of the invention, a lift chain has a tendency to swing and may make a large swing motion against a guide mast. However, the guide mast has a swing restrictor provided thereon, which restricts the swing motion of the lift chain so that the lift chain has a reduced tendency to swing.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
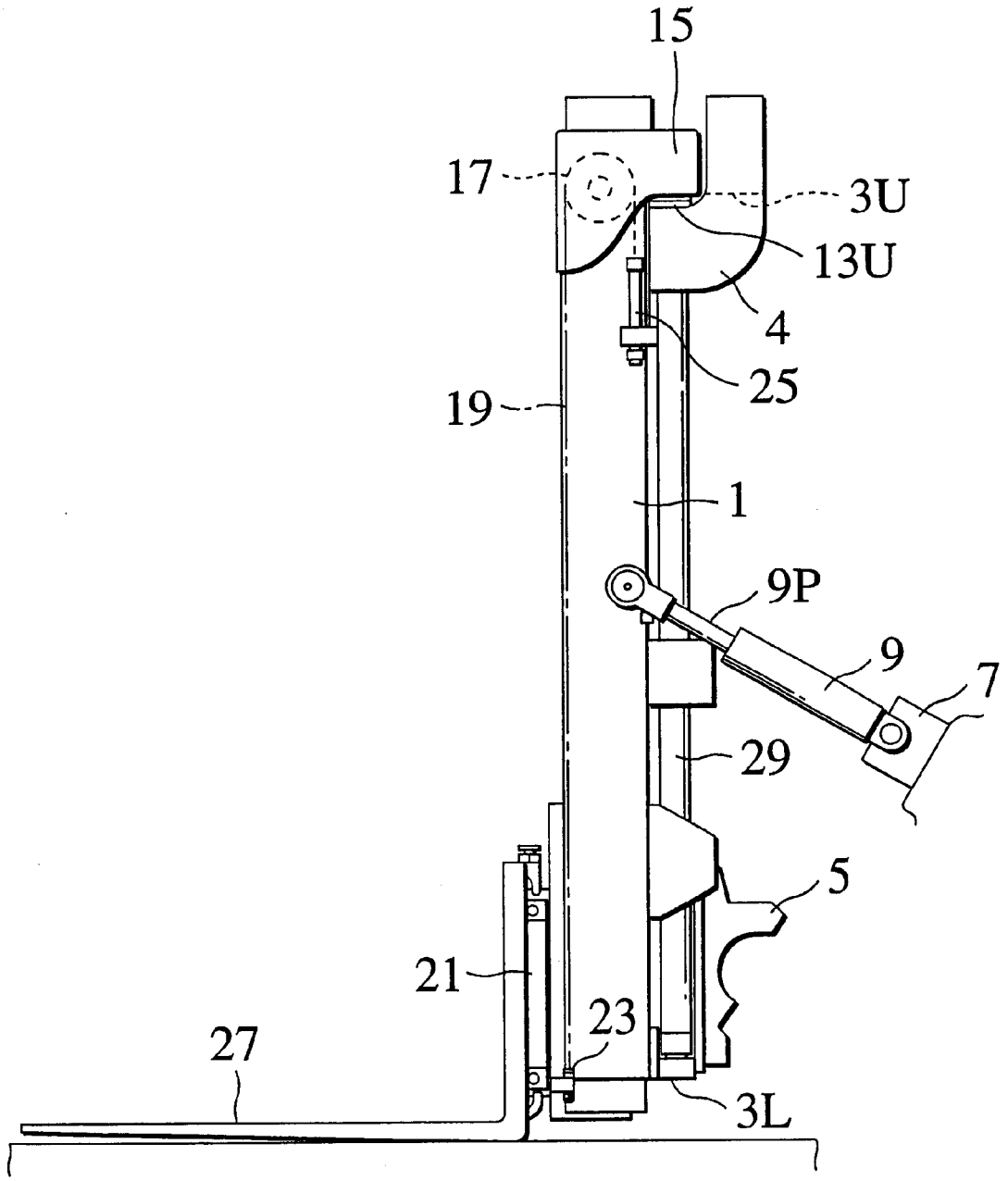
FIG. 1 PRIOR ART
FIG. 1 is a side elevation of a conventional mast apparatus in a state with a fork lowered.
Figure 2:
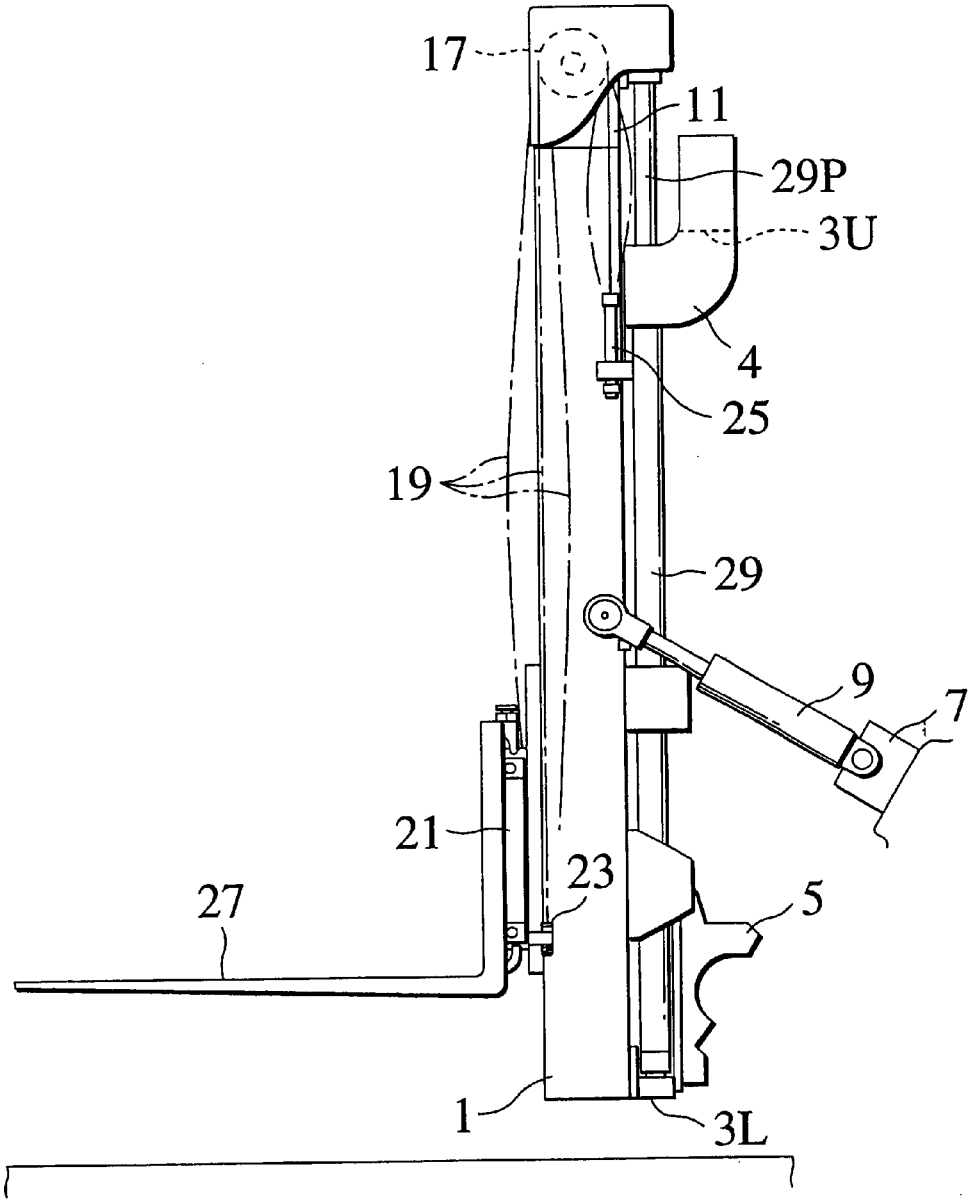
FIG.2 PRIOR ART
FIG. 2 is a side elevation of the conventional mast apparatus in a state with the fork slightly lifted.

There will be detailed below the preferred embodiments of the present invention with reference to the accompanying drawings. Like members are designated by like reference characters.

Figure 3:
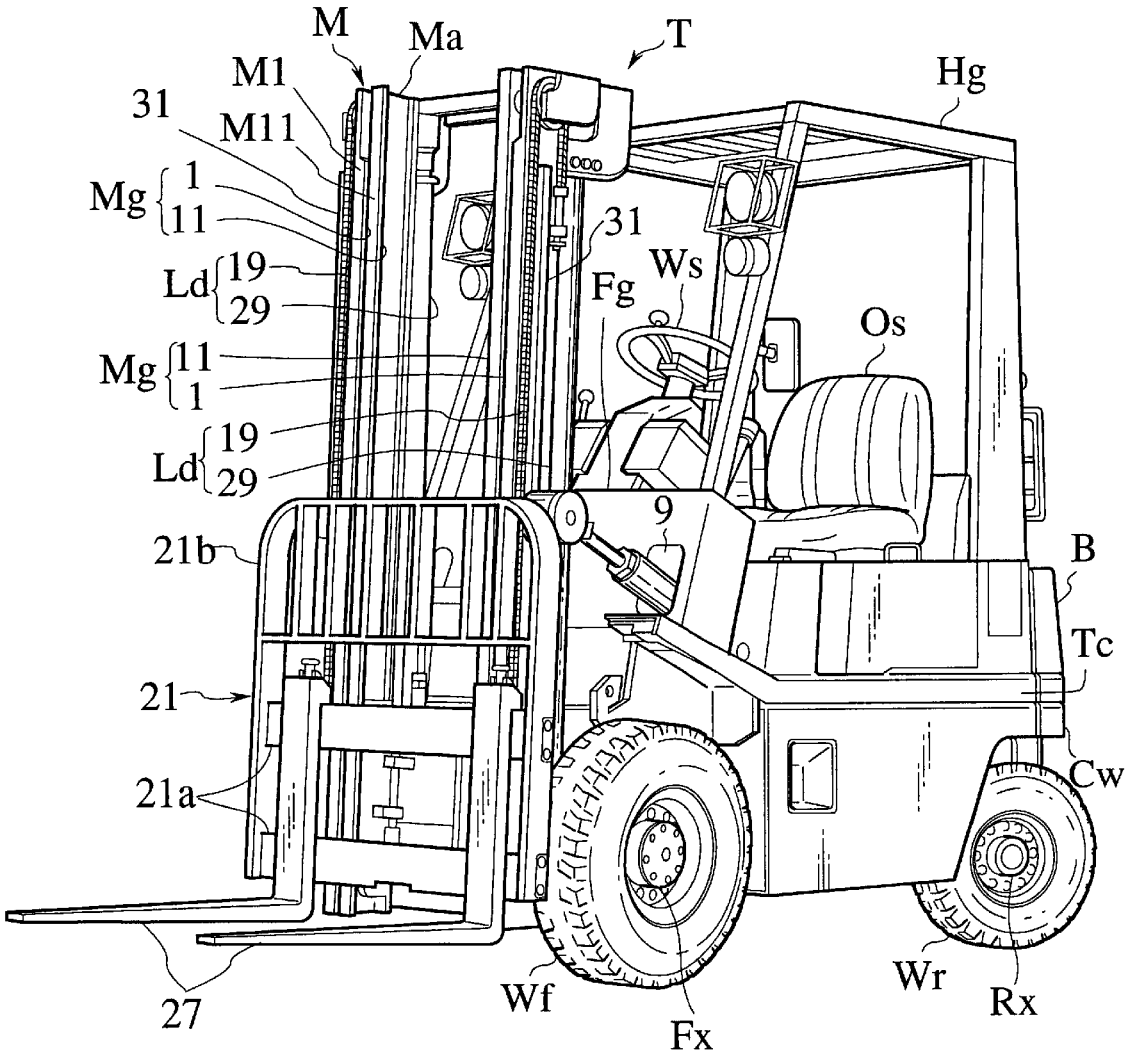
FIG. 3 is a perspective view of a lift truck according to an embodiment of the invention.
Figure 4:
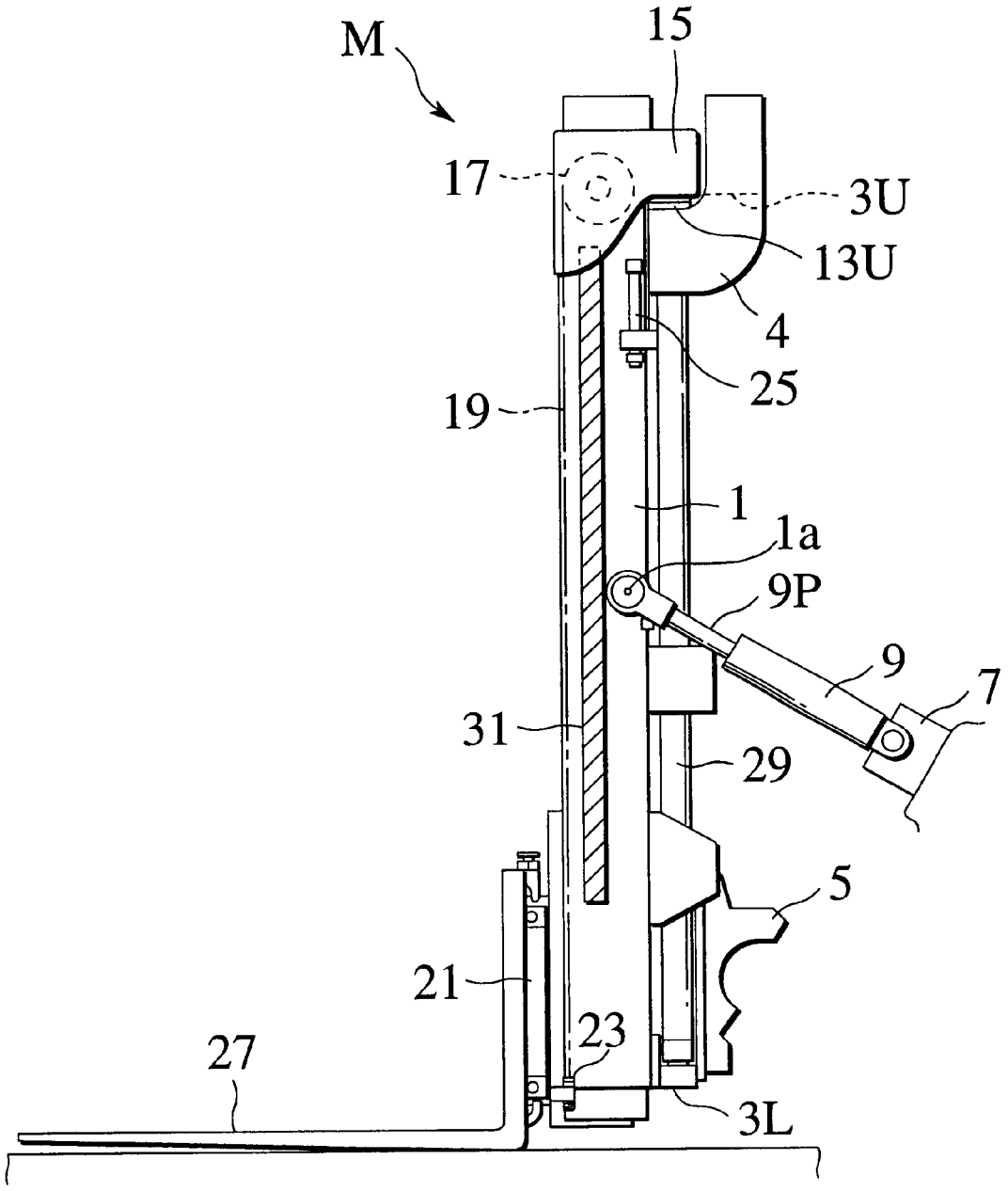
FIG. 4 is a side elevation of a mast apparatus of the lift truck of FIG. 3, in a state with a load-handling attachment lowered to a ground.
Figure 5:
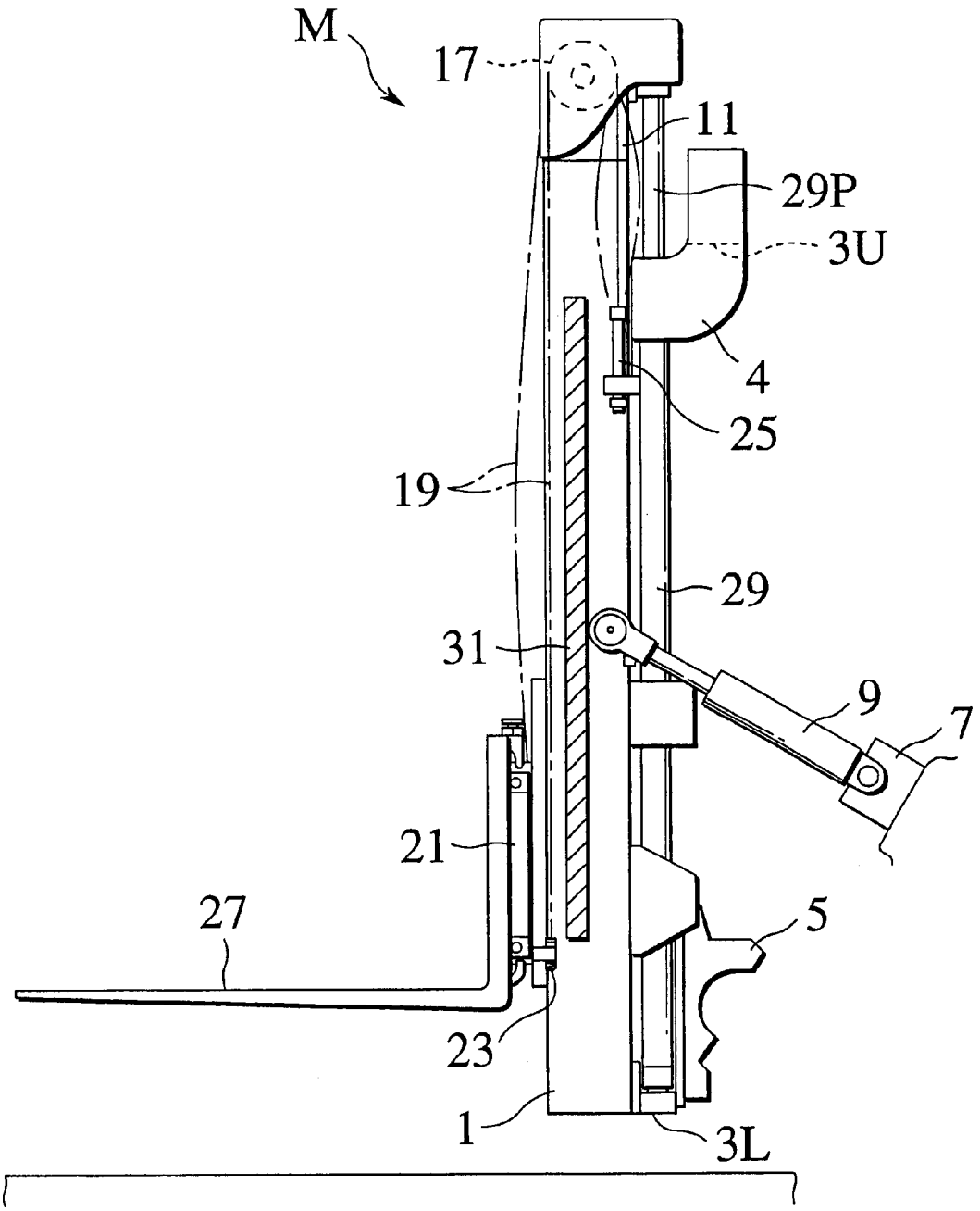
FIG. 5 is a side elevation of the mast apparatus of FIG. 4 in a state with the loadhandling attachment slightly lifted from the ground.
Figure 6:
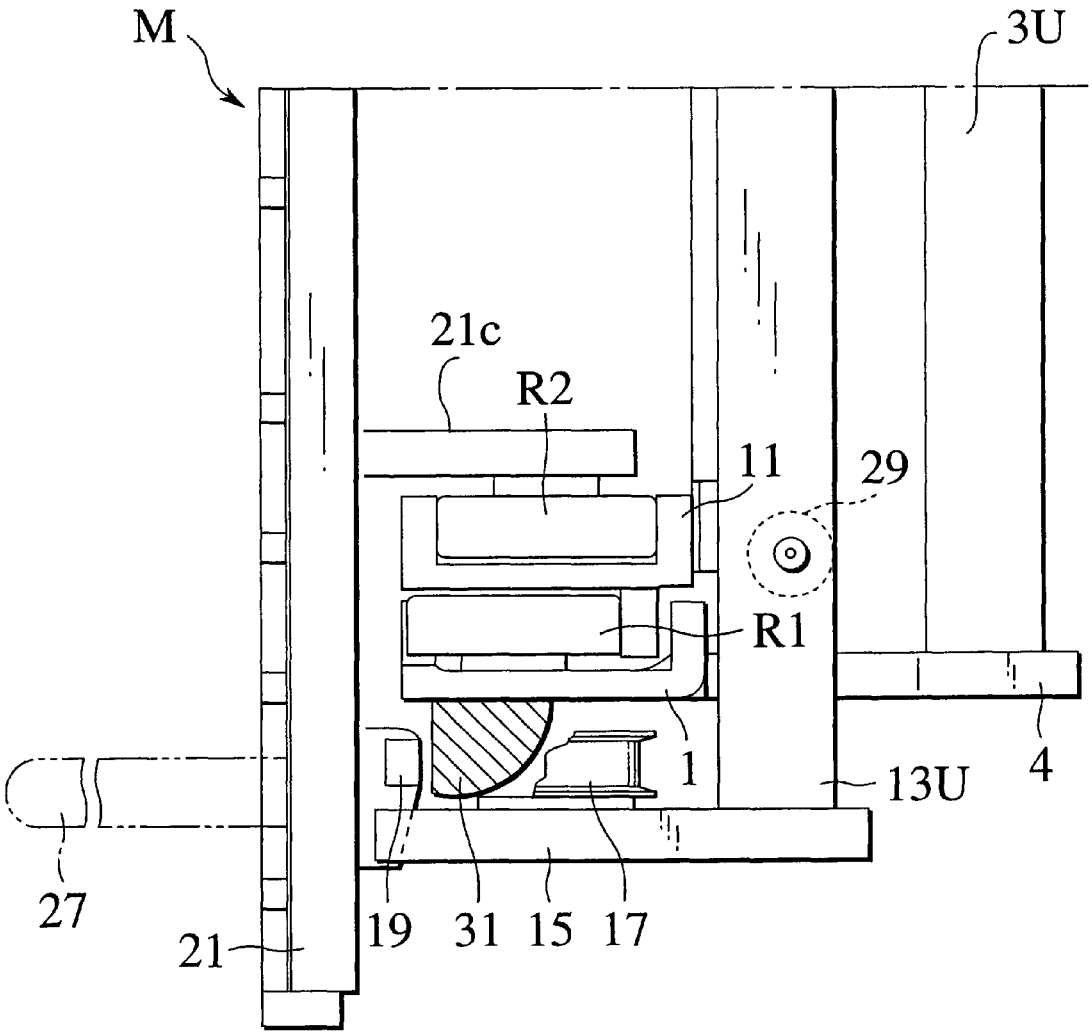
FIG. 6 is a plan, partly in section, of the mast apparatus of FIG. 4.

FIG. 3 shows a lift truck T in the form of a fork lift truck according to an embodiment of the invention, and FIGS. 4 to 6 show a mast apparatus M in the form of a mast-guided fork lift according to an embodiment of the invention.

The lift truck T comprises: a vehicle body B integrally formed with a truck chassis Tc and a rigid front axle assembly Fx; a swingable rear suspension including a rear axle assembly Rx; a pair of left and right front wheels Wr as driving solid or air-tube wheels supported by the front axle assembly Fx relative to the truck chassis Tc; a pair of left and right rear wheels Wr as steering air-tube wheels supported by the rear axle assembly Rx and swingably suspended by the rear suspension from the truck chassis Tc; and the mast apparatus M pivoting on the front axle assembly Fx.

The vehicle body B is thus directly or indirectly supported by the front and rear wheels Wf and Wr relative to the ground, and is integrally provided with a counter weight Cw, and a combination of a head guard Hg and a front guard Fg for protecting a lift operator or truck driver (not shown) sitting on an operator's seat Os which is mounted on a central portion of the truck chassis Tc.

The vehicle body B has mounted thereon: a vehicle drive system including an engine and a power train having a transmission; an operation system including a steering wheel Ws projecting over an instrument panel provided inside the front guard Fg, and acceleration and brake pedals, as well as mast and fork control levers and/or switches; a hydraulic system including a pump, hydraulic circuitry and a reservoir; an electrical system including a generator, a battery assembly, electric circuitry, controls, indicators, lights, etc., with part of wiring on the mast apparatus M.

The mast apparatus M comprises: a carriage 21 for carrying a load-handling attachment, i.e., a pair of left and right forks 27 in the embodiment; a pair of left and right lift drives Ld synchronously operable for driving the carriage 21 to be lifted and lowered; a gate-like mast assembly Ma including a pair of left and right vertical guide masts Mg for guiding the carriage 21 therealong, as it is lifted or lowerd by the lift drives Ld; and a pair of left and right swing restriction members 31 fixed alongside the guide masts Mg for restricting swing motions of the lift chains 19.

The carriage 21 comprises a grating frame as a rigid assembly including a rectangular load-backrest 21*b* and a pair of upper and lower transverse finger bars 21*a* joined to each other by left and right lift brackets 21*c* (FIG. 6). The forks 27 are hung on the finger bars 21*b* and locked or fastened thereto. The forks 27 may be replaced by any load-handling attachment for supporting a burden, a cargo, a freight, goods, a load or luggage (hereafter collectively called "load") scooped or picked up thereon or clamped or held thereto. There may be employed a side shift and/or a reach fork.

The guide mast assembly Ma comprises a gate-like inner mast M11 for vertically guiding the lift brackets 21*c* of the carriage 21, and a gate-like outer mast M1 for vertically guiding the inner mast M1.

The inner mast M11 comprises a pair of left and right vertical inner rails 11 interconnected by a plurality of transverse beams at different levels, such as an uppermost beam member 13U (FIGS. 4, 6) bridging a pair of left and right chain wheel brackets 15 (FIG. 6) fixed to the inner rails 11. Each inner rail 11 is C-shaped in section for accommodating a roller R2 (FIG. 6) provided on a lug of lift bracket 21*c*.

The outer mast M1 comprises a pair of left and right vertical outer rails 1 interconnected by a plurality of transverse beams at different levels, such as a lowest beam member 3L (FIG. 4) and an upper beam member 3U (FIGS. 4, 6) bridging left and right L-shaped brackets 4 (FIGS. 4, 6) fixed to the outer rails 1. The outer rails 1 have, at bottom parts thereof, left and right support brackets 5 (FIG. 4) pivoted on the front axle assembly Fx, and at vertically middle parts thereof, left and right lugs 1*a* (FIG. 4) operatively connected to piston rods 9P (FIG. 4) of left and right tilt cylinders 9, which have their cylinder cases operatively connected to left and right brackets 7 (FIG. 4) on front parts of the truck chassis Tc. Each outer rail 1 has guide rollers R1 (FIG. 6) arranged on a transversely inner side thereof, for a smooth guiding of an angled outside of inner rail 11.

The left and right guide masts Mg are each composed of a corresponding one of the left and right inner rails 11 and a corresponding one of the left and right outer rails 1, as the corresponding inner and outer rails constitute an extendible guide mast of a slide type.

The lift drives Ld comprise a pair of left and right lift cylinders 29, and a combination of a pair of left and right lift chains 19, a pair of left and right chain wheels 17 (FIGS. 4, 6), the chain wheel brackets 15, and the uppermost beam member 13U of the inner mast M11. The lift cylinders 29 have their cylinder cases set upright on the lowest beam member 3L of the outer mast M1, and their piston rods 29P (FIG. 5) operatively connected to the uppermost beam member 13U of the inner mast M11. The chain wheels 17 are rotatably attached to the chain wheel brackets 15. The lift chains 19 are applied over the chain wheels 17 and connected at their stationary ends to left and right level-adjustable anchor bolts 25, which are fixed to the outer rails 1, and at lifting ends of their swingable portions to left and right anchor bolts 23 fixed to the carriage 21.

Each swing restriction member 31 restricts a swing motion of lift chain 19 in the longitudinal direction, as well as in other directions. As shown in FIGS. 4–6, the swing restriction member 31 is provided on a transversely outer side of outer rail 1 in a vicinity of the swingable portion of the lift chain 19, as the lift chain 19 has its normal position, i.e., a vertically extending position in which it can be tensed over length for lifting the carriage 21 supporting the forks 27, as the guide mast Mg has its normal upright position without tilting nor loading. The swing restriction member 31 may be fixed in an applicable manner, such as by a fixing bolt, an adhesive or a welding.

As illustrated in FIG. 5, a lower end of the swing restriction member 31 is set near anchor bolt 23 fixed to the carriage 21, in a traveling state of the fork lift truck T, in which the carriage 21 is slightly lifted. As in FIG. 4, an upper end of the swing restriction member 31 is located within a region free of interference with chain wheel 17 when inner rail 11 is lowered to a lowest position. In other words, the swing restriction member 31 is provided in a vicinity of the lift chain 19, in correspondence to the swingable portion of the lift chain 19, or more specifically, in opposition to part or parts thereof having greater tendency or tendencies to swing.

The swing restriction member 31 may preferably be made of a non-ferrous material such as rubber, resin or aluminum. In case of an iron or steel, there may preferably be provided a buffer member, such as of rubber, cloth, resin or wood, over a region facing the lift chain 19.

According to the embodiment described, when the fork lift truck T travels with the lift chains 19 swinging in the longitudinal direction, as well as in other directions, due to undulations or the like on a road, the swing restriction members 31 restrict rearward swing motions of the lift chains 19 which abut thereon, so that the lift chains 19 have reduced tendencies to swing in the longitudinal direction.

Figure 7:
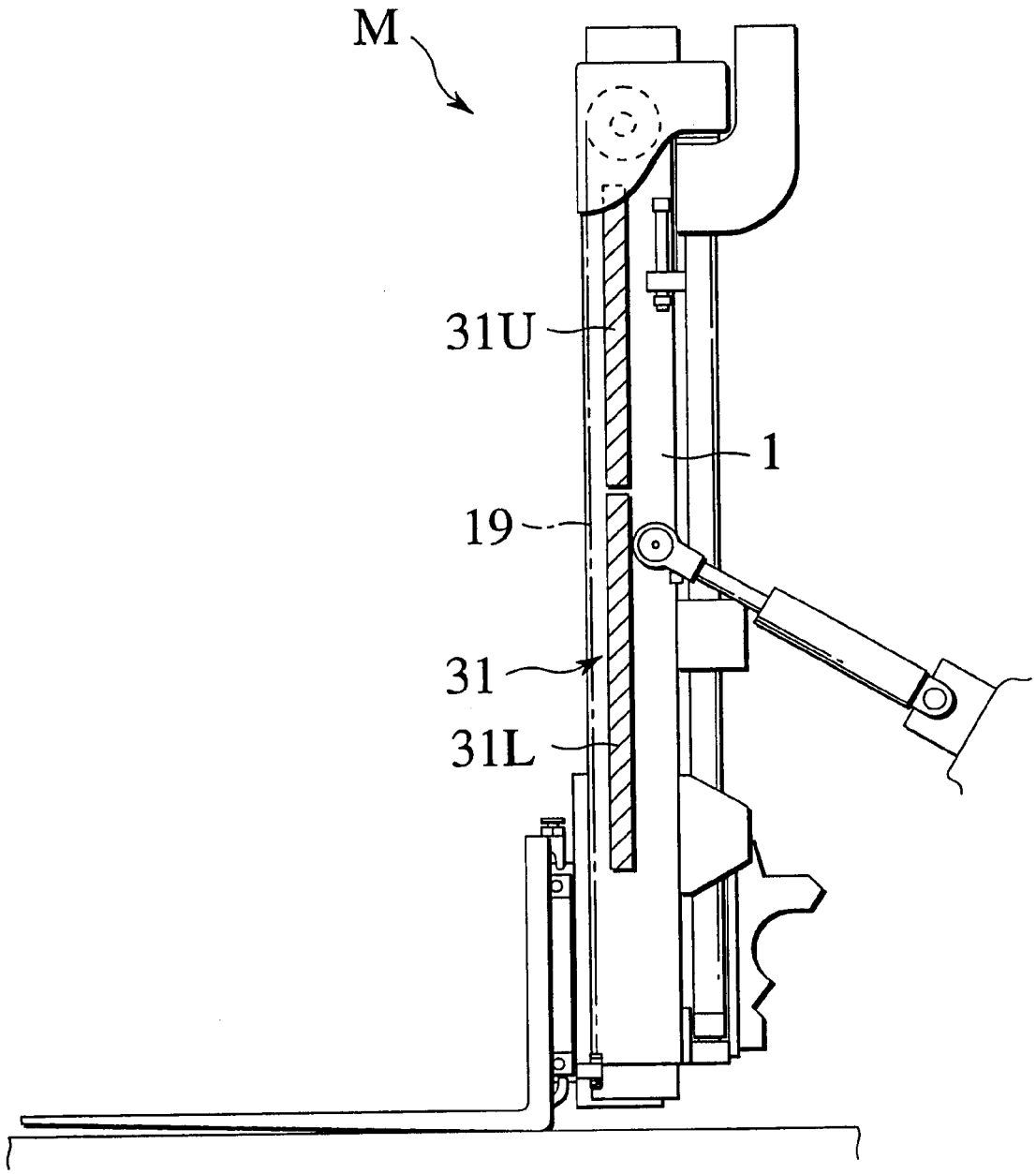
FIG. 7 is a side elevation of a mast apparatus according to an embodiment of the invention.
Figure 8:
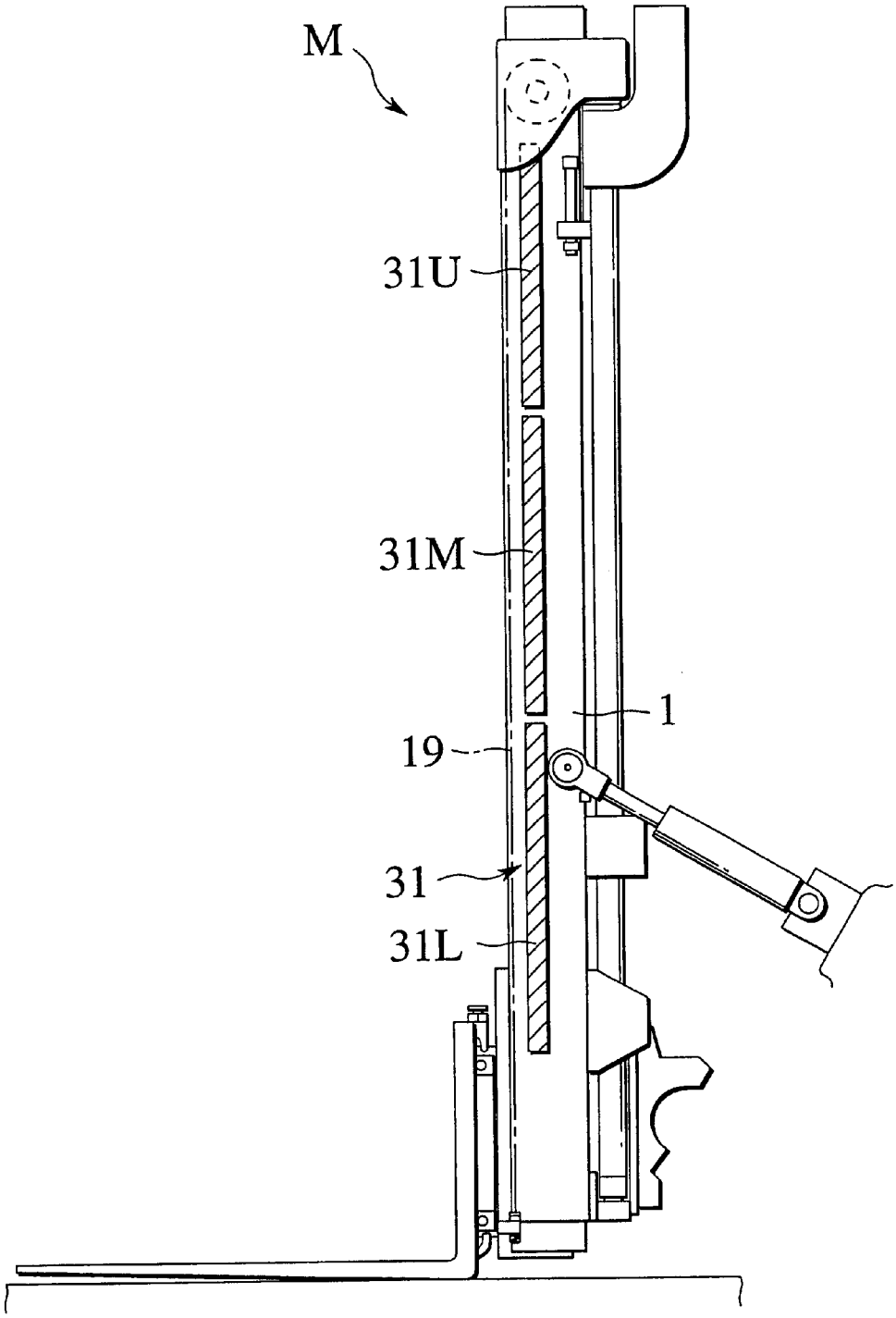
FIG. 8 is a side elevation of a mast apparatus according to an embodiment of the invention.

FIGS. 7 and 8 show mast apparatuses according to additional embodiments of the invention, in which swing restriction members 31 are each divided into a plurality of vertical segments. In other words, a set of swing restriction members are formed with shorter sizes in advance and selected to be combined to provide an arrangement allowing a facilitated coping even in a case the outer rails 1 have a different vertical dimension designed for a required different lift height.

In the embodiment of FIG. 7, a pair of upper and lower swing restriction members 31U and 31L are fixed, in combination, to an outer rail 1, thereby restricting a swing motion of a lift chain 19.

In the embodiment of FIG. 8, an upper, a middle and a lower swing restriction member 31U, 31M and 31L are fixed, in combination, to an outer rail 1, thereby restricting a swing motion of a lift chain 19.

According to these embodiments, a plurality of swing restriction members are vertically combined to cope with a variety of sizes of outer rails 1, permitting a post application to an existing fork lift truck.

Figure 9:
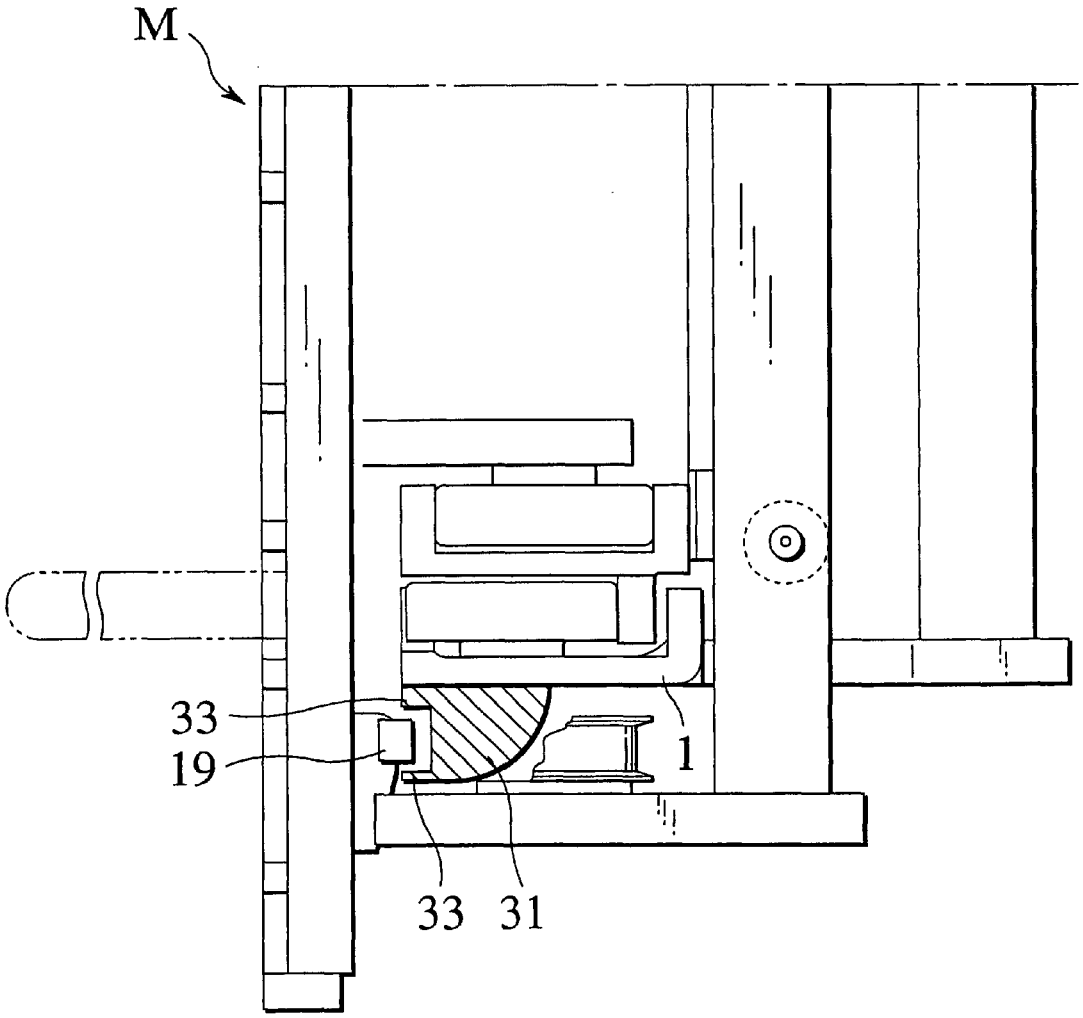
FIG. 9 is a plan, partly in section, of a mast apparatus according to an embodiment of the invention.

FIG. 9 shows a mast apparatus according to another embodiment of the invention, in which a swing motion of a lift chain 19 is suppressed in a transverse direction by providing a swing restriction member 31 with left and right projections 33 located at the left and right of the lift chain 19, in addition to an effective restriction in a longitudinal direction. In other words, part of the lift chain 19 is surrounded at the back and both sides thereof by the swing restriction member 31 and its projections 33.

According to this embodiment, the lift chain 19 abuts on a body of the swing restriction member 31, when swung in the longitudinal direction, or on either projection 33, when swung in the transverse direction, and has suppressed tendencies to swing in longitudinal and transverse directions.

In the foregoing embodiments, each swing restriction member 31 may preferably have magnets provided thereto for magnetically attracting an associated lift chain 19 to suppress a swing motion.

The remaining drawings show a diversity of swing restriction members according to additional embodiments of the invention, which are supposed to be provided on each outer rail 1 of the fork lift truck T of FIG. 3, alone or in combination for effective swing restriction of an associated lift chain 19, and will be collectively called "swing restrictor" that will be designated by a reference character of "(10 times numeral part of associated Figure No.)+(small letter of alphabetical part of the Figure No., as necessary)+(suffix, as necessary)".

Figure 10A:
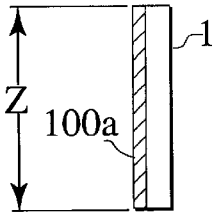
FIGS. 10A to 10C are side views of various lengths of swing restrictors according to embodiments of the invention.
Figure 10B:
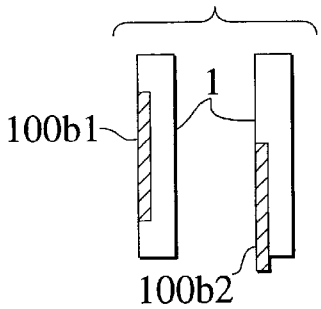
Figure 10C:
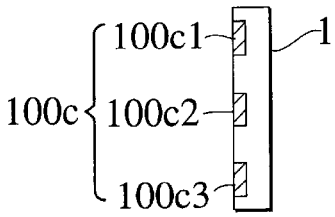

FIGS. 10A to 10C illustrate a vertical zone for swing restrictors according to the invention to be present. All swing restrictors 100*a*, 100$b_2$, 100$b_2$ and 100*c* and swing restricting component members 100$c_1$, 100$c_2$ and 100$c_3$ thereof each have a swing restricting part thereof residing in a vertical zone Z between a top and a bottom of an outer rail 1. Swing restrictor 100*a* fully covers the vertical zone Z. Swing restrictor 100$b_1$, covers an intermediate region of the zone Z. Swing restrictor 100$b_2$ covers a lower half of the zone Z, projecting downwards, or may cover an upper half, projecting upwards. Separate component members 100$c_1$, 100$c_2$ and 100$c_3$ of swing restrictor 100*c* cover an upper, a middle and a lower region of the zone Z, respectively.

Figure 10D:
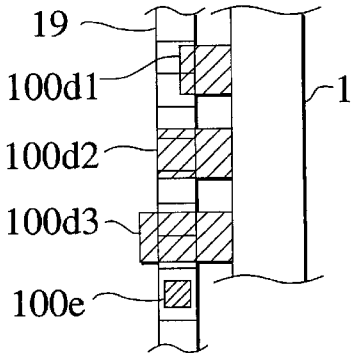
FIG. 10D is a collective illustration of rear views of different widths of swing restrictors according to embodiments of the invention.
Figure 10E:
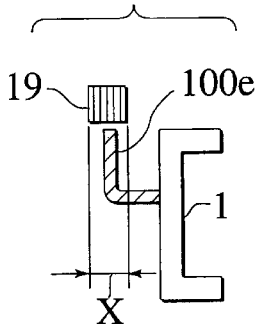
FIG. 10E is a plan of one of the swing restrictors of FIG. 10D.
Figure 10F:
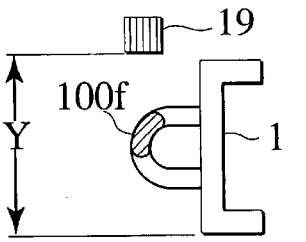
FIG. 10F is an illustration describing a thickness relationship of a swing restrictor according to an embodiment of the invention.
Figure 10G:
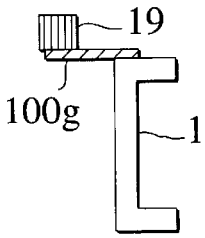
FIGS. 10G to 10I are plans of various thicknesses of swing restrictors according to embodiments of the invention.
Figure 10H:
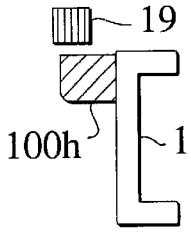
Figure 10I:
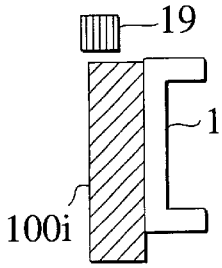

FIGS. 10D and 10E illustrate a transverse zone for swing restrictors according to the invention to be present. All swing restrictors 100$d_1$, 100$d_2$, 100$d_3$ and 100*e* as well as unshown swing restricting component members thereof each have a swing restricting part thereof residing in a transverse zone X as a mapped dimension between a left side and a right side of a lift chain 19 in a normal position. Swing restrictor 100$d_1$, covers a right half region of the zone X, or may cover a left half region. Swing restrictor 100$d_2$ fully covers the zone X. Swing restrictor 100$d_3$ also covers the zone X, projecting leftwards. Swing restrictor 100*e* covers, at a free front end of an angle form thereof, a central region of the zone X.

FIGS. 10F to 10I illustrate a longitudinal zone for swing restrictors according to the invention to be present. All swing restrictors 100*f*, 100*g*, 100*h* and 100*i* as well as unshown swing restricting component members thereof each have a swing restricting part thereof residing in a longitudinal zone Y between a rear side of an outer rail 1 and a rear side of a lift chain 19 in a normal position. Swing restrictor 100*f* of a broken half-cylinder configuration vertically extends as a protective enclosure (defining a wire accommodation space) in a central region of the zone Y. Swing restrictor 100*g* extends in a front end space of the zone Y. Swing restrictor 100*h* extends in a front region of the zone Y. Swing restrictor

100*i* extends over a full region of the zone Y, with a rear exceeding portion.

Figure 11A:
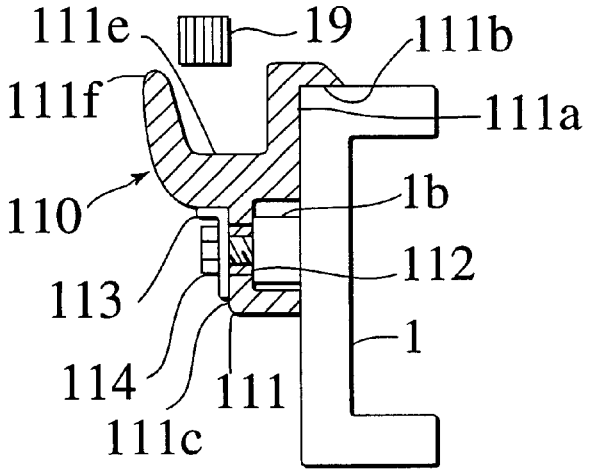
FIGS. 11A, 11B and 11C are a plan, a side view and an exploded view, respectively, of a swing restrictor according to an embodiment of the invention.
Figure 11B:
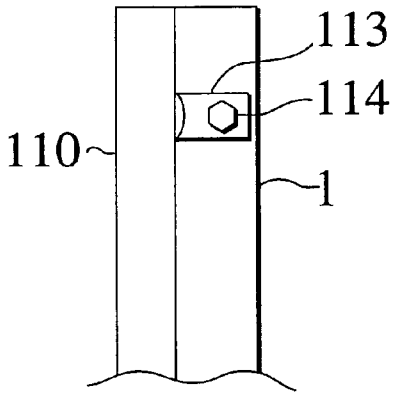
Figure 11C:
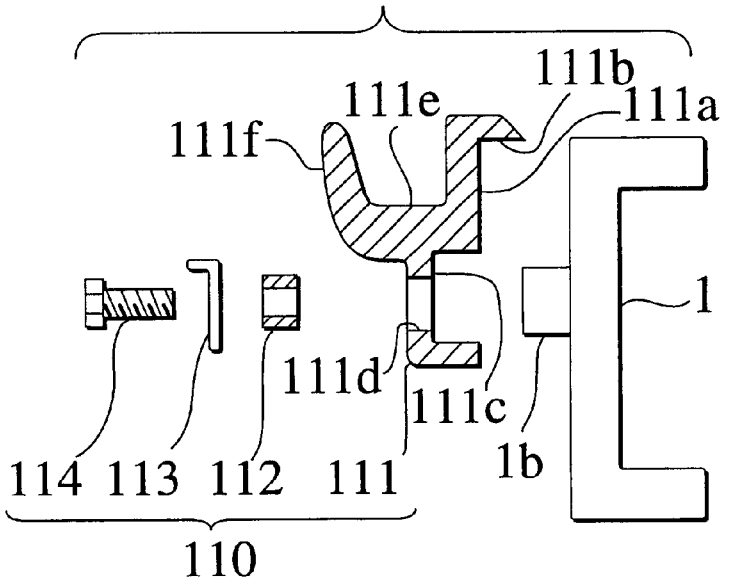

FIGS. 11A to 11C show a swing restrictor 110 according to an embodiment of the invention. The swing restrictor 110 comprises an extruded or molded swing restriction member 111 of a bird form in section, a distance collar 112, an angled fixing plate 113, and a fixing bolt 114 to be screwed to a boss 1*b* formed on an outer rail 1. A cross section of the swing restriction member 111 has a neck part 111*a* resting on a transversely outer side of the rail 1, a bill part 111*b* fixed or resting on a longitudinally front side of the rail 1, a leg part 111*c* formed with a through hole 111*d* for inserting the collar 112, a head-to-waist back part 100*e* bent at a right angle, and a tail part 100*f* raised to extend or project forwards, cooperating with the back part 111*e* to define a trough for receiving a lift chain 19, as it swings rearward.

Figure 12A:
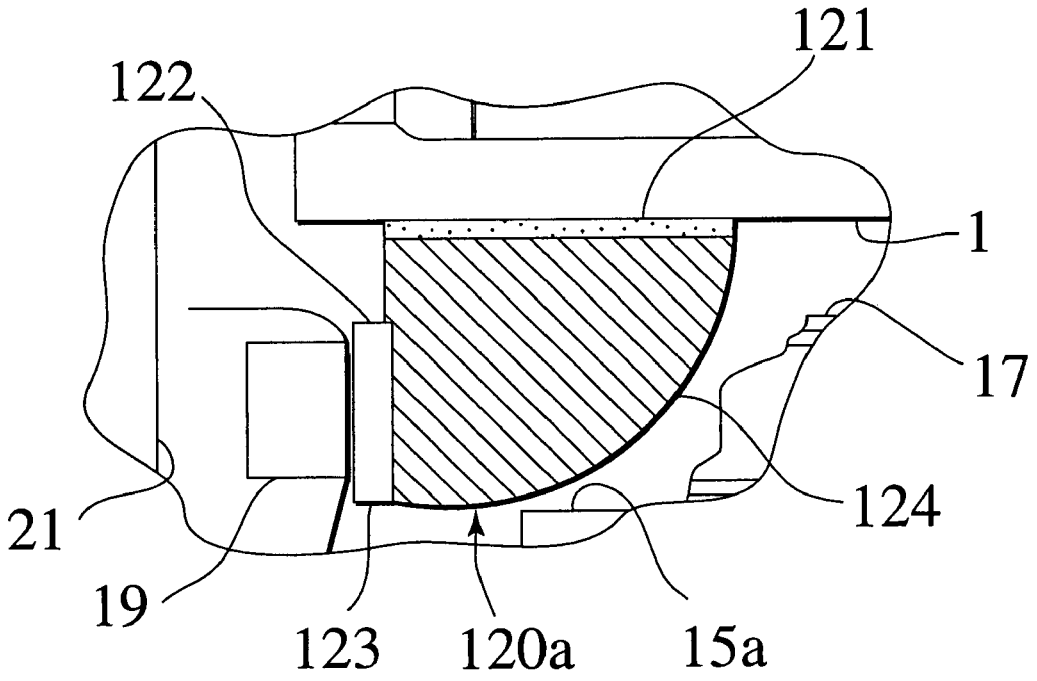
FIGS. 12A and 12B are sectional plans of different structures of swing restrictors according to embodiments of the invention.
Figure 12B:
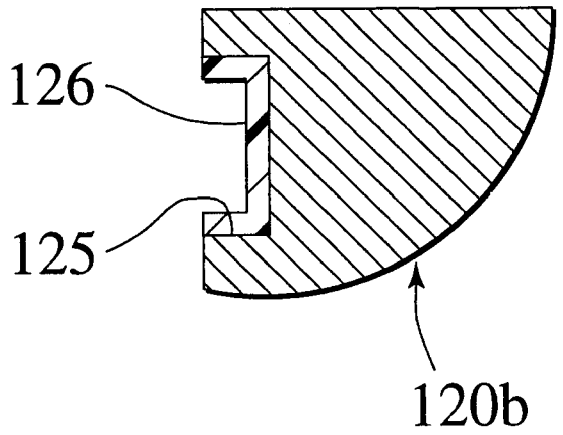
Figure 13A:
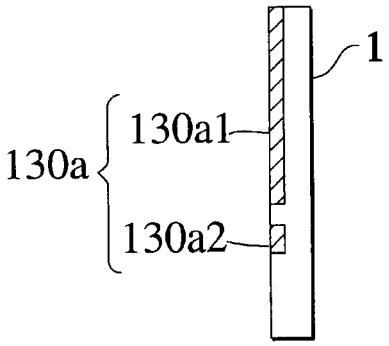
FIGS. 13A to 13D are side views of different constitutions of swing restrictors according to embodiments of the invention.
Figure 13B:
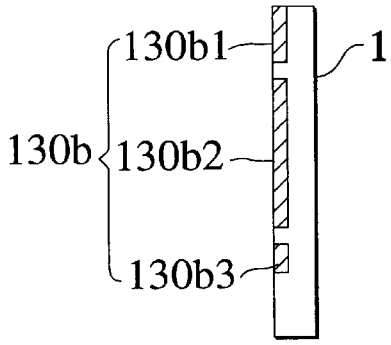
Figure 13C:
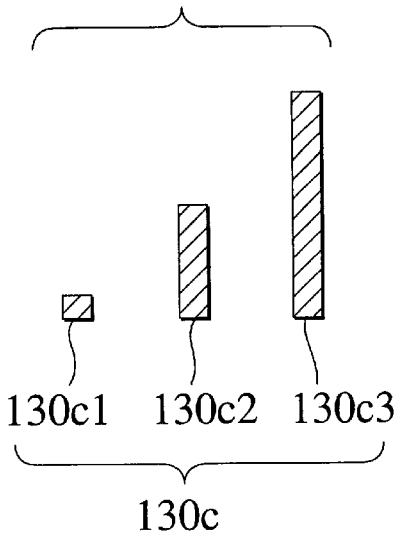
Figure 13D:
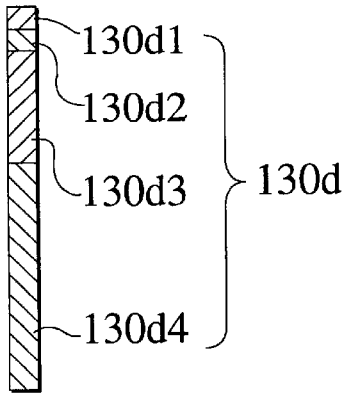

FIGS. 12A and 12B show buffering structures of swing restrictors 120*a*, 120*b* according to embodiments of the invention. The swing restrictor 120*a* is for swing restriction of a left lift chain 19 in this case, and is fixed over a total length (or spaced lengths) of a right side thereof by adhesive agent or both-side adhesive tape 121 to a left outer side of the rail 1. The restrictor 120*a* has a stepped part 122 at a left region of a front side thereof for a buffer member 123 to be attached thereto or coated thereon to buffer a hitting impact of the chain 19 that lifts a carriage 21. The restrictor 120*a* is formed round in section over a peripheral side 124 thereof that faces a chain wheel 17 fixed to a chain wheel base 15*a* on a chain wheel bracket. The round side 124 is free of binding of the chain 19. The swing restrictor 120*b* has a front recess 125 formed along a total length (or spaced lengths) of a front side thereof for a buffer member 126 (or buffer members) to be coated thereon in a U-form in section.

FIGS. 13A to 13D show various proportions of length division of swing restrictors 130*a*, 130*b* and 130*d* and a swing restrictor system 130*c* according to embodiments of the invention. Swing restrictor 130*a* is divided into a combination of a long restriction member $\mathbf{130}a_1$ to be fixed to an upper portion of an outer rail 1 and a short restriction member $\mathbf{130}a_2$ to be fixed at a lower part of the rail 1. Swing restrictor 130*b* is divided into a combination of a medium-length restriction member $\mathbf{130}b_1$, to be fixed to an upper part of an outer rail 1, a longer restriction member $\mathbf{130}b_2$ to be fixed to a central portion of the rail 1, and a shorter restriction member $\mathbf{130}b_3$ to be fixed to a lower part of the rail 1. Swing restrictor system 130*c* comprises a set of short (10 mm), mediate (50 mm) and long (100 mm) restriction members $\mathbf{130}c_1$, $\mathbf{130}c_2$ and $\mathbf{130}c_3$ of an identical material or different materials, permitting a voluntary selection to constitute a desirable swing restrictor. Swing restrictor 130*d* comprises a combination of a short, another short, a mediate and a long restriction member $\mathbf{130}d_1$, $\mathbf{130}d_2$, $\mathbf{130}d_3$ and $\mathbf{130}d_4$ of different materials, which may be selected from the restriction member set 130*c*.

Figure 14A:
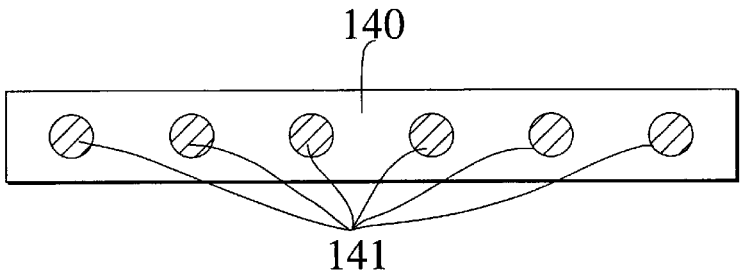
FIGS. 14A is an illustration of a front view of a swing restrictor according to an embodiment of the invention.
Figure 14B:
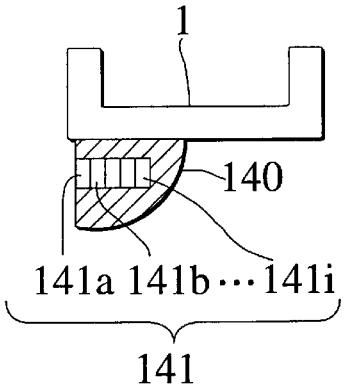
FIG. 14B is a sectional plan of the swing restrictor of FIG. 14A.

FIGS. 14A and 14B show a magnet arrangement in a swing restrictor 140 according to an embodiment of the invention. The swing restrictor 140 has a combination of sets 141 of magnets 141*a*, 141*b*, . . . , 140*i* embedded therein for exerting electromagnetic attractive forces on a swung part of lift chain. The magnet sets 141 are arrayed at even intervals, over length of a front side of the restrictor 140. Each magnet set 141 is buried into a two-third depth of a body of the restrictor 140. Formed or sheet-like arrayed magnets or magnet sets may be arranged in a similar manner to buffer(s) of FIGS. 12A, 12B.

Figure 15A:
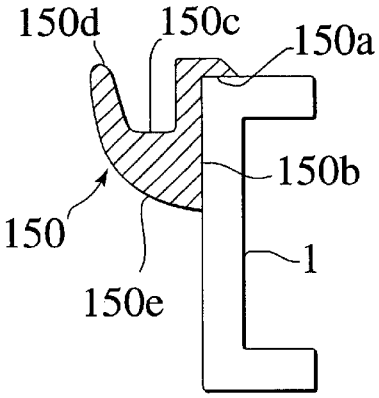
FIG. 15A is a sectional plan of a swing restrictor according to an embodiment of the invention.
Figure 15B:
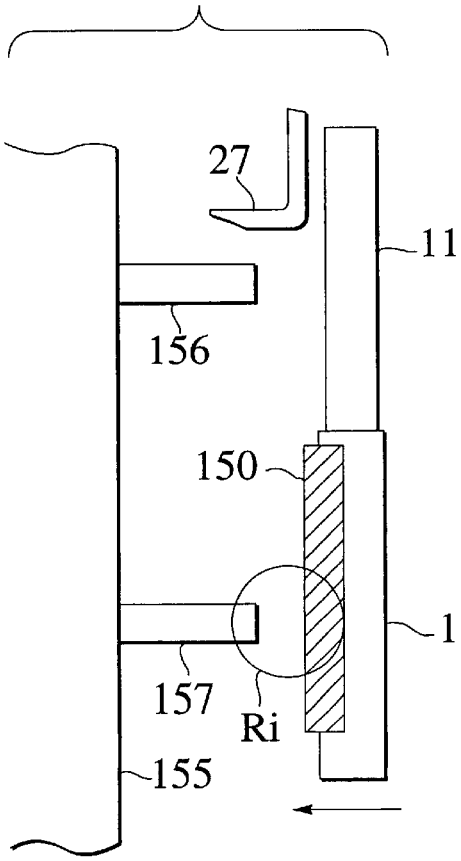
FIG. 15B is an illustration of a scene in which the swing restrictor of FIG. 15A exhibits an effect.

FIG. 15A shows an extruded bird-form swing restrictor 150 according to an embodiment of the invention, and FIG. 15B describes a direct-interference preventing effect of the restrictor 150. As shown in FIG. 15A, the swing restrictor 150 comprises a bill part 11*a* resting on a longitudinally front side of an outer rail 1, a neck part 150*b* resting on a transversely outer side of the rail 1, a head-to-waist back part 150*c* bent at a right angle, a tail part 150*d* extending forwards, cooperating with the back part 150*c* to define a trough for receiving part of a lift chain swung rearward, and a leg-less round belly part 150*e*. The bill part 111*a* prevents the chain (or anything else standing in front) from directly interfering with a covered region of the front side of the rail 1, permitting a reduced level of hitting noises and a safe protection of the covered region or of a front side of guide mast. For example, as in FIG. 15B, when forks 27 are lifted with an extended inner rail 11 to place a heavy load (needing a rearward tilt) on an upper pallet or shelf 156 of a container 155 or on a truck or the like, a front side of an outer rail 1 is exposed to an interference region Ri, where it otherwise might have directly collided on a lower pallet or shelf 157 or a tail of truck body or the like. According to the embodiment, such a collision is prevented by a head part (including the bill part 150*a*) of the swing restrictor 150.

Figure 16A:
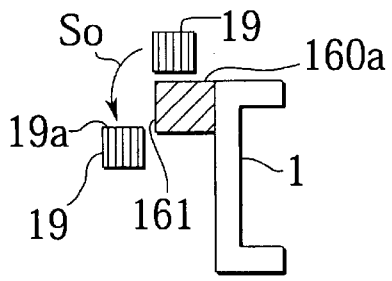
FIGS. 16A to 16C are plans of various anti-binding arrangements of swing restrictors according to embodiments of the invention.
Figure 16B:
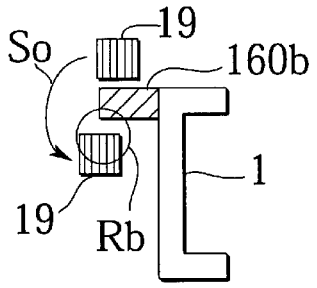
Figure 16C:
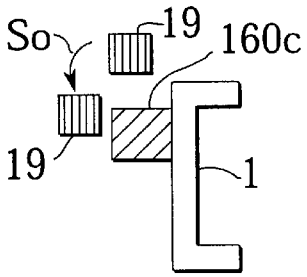

FIGS. 16A to 16C describe a binding prevention effect of swing restrictors 160*a* and 160*c* according to embodiments of the invention. A loose lift chain 19 may swing along an outermost path So beyond a thin or front-ended restrictor 160*b* and occasionally bind on something (which may be a backside of the restrictor 160*b*) in a probable binding region Rb between an end of the restrictor 160*b* and an outside of an outer rail 1. Swing restrictor 160*a* is thick, and has a lateral rear part 161 thereof standing on a way of a swing-over path So, effectively reducing a binding tendency of a swung part of the chain 1. Swing restrictor 160*c* is located behind a front edge of the rail 1 so that a lateral face of the restrictor 160*c* stands on a way of a swing-over path So. In other words, the swing restrictors 160*a* and 160*c* each have a lateral side extending rearwards relative to a front side of a rearmost swung part of the lift chain 19.

Figure 17A:
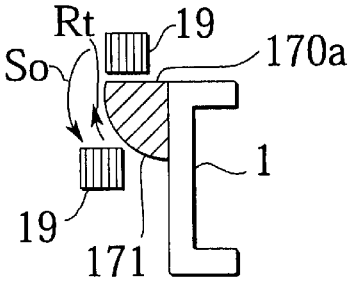
FIG. 17A is a plan describing an improved chain return characteristic of a swing restrictor according to an embodiment of the invention.
Figure 17B:
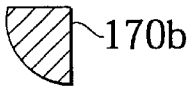
FIGS. 17B to 17E are plans of various configurations of swing restrictors according to embodiments of the invention.
Figure 17C:
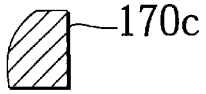
Figure 17D:
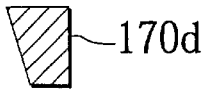
Figure 17E:
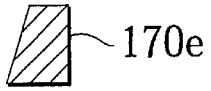

FIG. 17A describes a return promotion effect of a swing restrictor 170*a* according to an embodiment of the invention. A lift chain 19 may swing along a path So over the restrictor 170*a*, therebehind. However, the restrictor 170*a* has a round circumference 171, which extends between from an outside of an outer rail 1 to a left edge of a front side of the restrictor 170*a* and on which the chain 19 is caused to have a promoted tendency to return along a return path Rt to its place in a normal position of the chain 19.

FIGS. 17B to 17E illustrate a variety of sectional shapes of swing restrictors 170*b*, 170*c*, 170*d* and 170*e* according to embodiments of the invention, as they are configured in consideration of the return promotion effect. Swing restrictor 170*b* is curved arcuate between a left edge of a front side and a rear edge of a right side. Swing restrictor 170*c* has an arcuately or obliquely curved lateral side. Swing restrictors 170*d* and 170*e* have a tapered (i.e. inclined or declined) lateral side.

It will be seen that the foregoing embodiments are disclosed by topics for comprehension and may be combined in a voluntary manner.

As will be seen from the embodiments, an aspect of the invention provides a mast apparatus for a fork lift truck, in which an inner mast is provided in a vertically movable manner to an outer mast to be supported on a vehicle body of the fork lift truck, and a chain wheel, over which a lift chain for lifting and lowering a carriage which is vertically movably guided by the inner mast is applied, is rotatably provided to a chain wheel bracket which is integrally provided to the inner mast, wherein the outer mast is provided with a swing restriction member for restricting a swing motion of the lift chain in forward and backward directions.

According to this aspect, a mast apparatus for a fork lift truck has an outer mast to be supported by a vehicle body of the fork lift truck, an inner mast is provided to the outer mast in a vertically movable manner, a carriage is vertically movably guided by the inner mast, a lift chain for lifting and lowering the carriage is applied over a chain wheel, the chain wheel is rotatably provided to a chain wheel bracket, the chain wheel bracket is integrally provided to the inner mast, and the outer mast is provided with a swing restriction member for restricting a swing motion of the lift chain in forward and backward directions, so that when a fork lift truck equipped with the mast apparatus travels on a road and is caused to swing or roll by undulations on the road, even if the lift chain has an increased tendency to swing in the forward and backward directions, this chain is then brought into abutment on the swing restriction member and has a suppressed swing in the forward and backward directions.

According to another aspect, the swing restriction member is provided with projections located at left and right sides of the lift chain for restricting a swing motion of the lift chain in leftward and rightward directions.

According to this aspect, a swing restriction member has projections located at left and right sides of a lift chain, for restricting a swing motion of the lift chain in leftward and rightward directions, so that when the lift chain is caused to significantly swing to the left and right as well as forwards and rearwards, this chain is then brought into abutment on the projections of the swing restriction member and has a suppressed swing in the leftward and rightward directions.

According to another aspect, the swing restriction member is divided in a vertical direction into a plurality of divided members.

According to this aspect, as a swing restriction member is divided in a vertical direction into a plurality of divided members, an increase or decrease in number of divided members allows a facilitated coping to a case in which outer masts have different vertical dimensions depending on a difference in lift height of fork lift trucks.

According to another aspect, a part of the swing restriction member facing the lift chain is non-ferrous.

According to this aspect, a swing restriction member has a non-ferrous part thereof facing a lift chain so that, upon abutment on the swing restriction member, the lift chain produces a reduced level of impact sounds in addition to that a swing motion can be suppressed.

According to another aspect, the swing restriction member is provided with a magnet capable of attracting and magnetically attaching the lift chain thereto.

According to this aspect, as a swing restriction member is provided with a magnet capable of attracting and magnetically attaching a lift chain thereto, upon abutment on the swing restriction member the lift chain is effectively attached thereto so that its swing motion is suppressed.

While preferred embodiments of the present invention have been described using specific terms, such description is for illustrative purposes, and it is to be understood that changes and variations may be made without departing from the spirit or scope of the following claims.

What is claimed is:

1. A lift truck comprising:

a vehicle body supported by a plurality of wheels;

a carrier for carrying a load-handling attachment;

a lift drive for lifting the carrier, the lift drive including a lift chain connected to the carrier;

a guide mast supported by the vehicle body for guiding the carrier along the guide mast; and a swing restrictor provided on the guide mast for restricting a swing motion of the lift chain, wherein the guide mast has a front side facing the carrier and a lateral side crossing the front side, and the swing restrictor comprises a swing restriction member fixed to one of the front side and the lateral side of the guide mast for restricting the swing motion of the lift chain.

2. A mast apparatus for lift trucks, comprising:

a carrier for carrying a load-handling attachment;

a lift drive for lifting the carrier, the lift drive including a lift chain connected to the carrier;

a guide mast for guiding the carrier along the guide mast; and a swing restrictor provided on the guide mast for restricting a swing motion of the lift chain, wherein the guide mast has a front side thereof facing the carrier and a lateral side thereof crossing the front side, and the swing restrictor comprises a swing restriction member fixed to one of the front side and the lateral side of the guide mast for restricting the swing motion of the lift chain.

3. The mast apparatus as claimed in claim 2, wherein the swing restriction member has:

a front side thereof facing a swingable portion of the lift chain, as the lift chain is in a normal position thereof for lifting the carrier; and one of a first lateral side thereof neighboring the front side of the swing restriction member and a second lateral side thereof extending between an edge of the front side of the swing restriction member and the lateral side of the guide mast.

4. The mast apparatus as claimed in claim 3, wherein the swing restriction member has a configured portion for reducing a tendency for a swung part of the lift chain to laterally swing.

5. The mast apparatus as claimed in claim 4, wherein the configured portion comprises a raised part of the front side of the swing restriction member.

6. The mast apparatus as claimed in claim 4, wherein the configured portion comprises a recessed part of the front side of the swing restriction member.

7. The mast apparatus as claimed in claim 3, wherein the swing restriction member has a configured portion for protecting the front side of the guide mast.

8. The mast apparatus as claimed in claim 7, wherein the configured portion comprises an extended part of the swing restriction member resting on part of the front side of the guide mast.

9. The mast apparatus as claimed in claim 3, wherein the swing restriction member has a configured portion for reducing a binding tendency of a swung part of the lift chain.

10. The mast apparatus as claimed in claim 9, wherein the configured portion comprises a round surface of the second lateral side of the swing restriction member.

11. The mast apparatus as claimed in claim 9, wherein the configured portion comprises an extended surface of the first lateral side of the swing restriction member.

12. The mast apparatus as claimed in claim 3, wherein the swing restriction member has configured portion a returning tendency of a swung part of the lift chain.

13. The mast apparatus as claimed in claim 12, wherein the configured portion comprises a tapered surface of the first lateral side of the swing restriction member.

14. The mast apparatus as claimed in claim 12, wherein the configured portion comprises a curved surface of the one of the first lateral side of the swing restriction member and the second lateral side of the swing restriction member.

15. The mast apparatus as claimed in claim 3, wherein the swing restriction member has a configured portion for defining an accommodation space.

16. The mast apparatus as claimed in claim 2, wherein the swing restrictor comprises:

the swing restriction member fixed to the lateral side of the guide mast; and a magnetic element fixed to the swing restriction member for exerting an electromagnetic force to a swung part of the lift chain.

17. The mast apparatus as claimed in claim 2, wherein the swing restrictor comprises:

the swing restriction member fixed to the lateral side of the guide mast; and a buffer member provided on the swing restriction member for buffering an impact of a swung part of the lift chain.

18. The mast apparatus as claimed in claim 2, wherein the swing restrictor comprises another swing restriction member fixed to the one of the front side and the lateral side of the guide mast for restricting the swing motion of the lift chain.

19. The mast apparatus as claimed in claim 2, wherein: the guide mast comprises an inner rail for guiding the carrier, and an outer rail for guiding the inner rail; and the swing restrictor is fixed to the outer rail.

20. The mast apparatus as claimed in claim 19, wherein the lift drive comprises:

a chain wheel rotatably fixed relative to the inner rail;

the lift chain applied over the chain wheel and connected to the outer rail; and a lift cylinder operatively connected to the inner rail.

* * * * *